US012258196B2

(12) United States Patent
Henigman

(10) Patent No.: US 12,258,196 B2
(45) Date of Patent: Mar. 25, 2025

(54) ENVIROTRAY INSERT FOR PROTECTING AN OBJECT WITHIN AN OUTER CONTAINER

(71) Applicant: GENERAL FIBRE PRODUCTS CORP., New Hyde Park, NY (US)

(72) Inventor: Dusan Henigman, New Hyde Park, NY (US)

(73) Assignee: GENERAL FIBRE PRODUCTS CORP., New Hyde Park, NY (US)

( * ) Notice: Subject to any disclaimer, the term of this patent is extended or adjusted under 35 U.S.C. 154(b) by 99 days.

(21) Appl. No.: 18/122,387

(22) Filed: Mar. 16, 2023

(65) Prior Publication Data

US 2023/0219734 A1 Jul. 13, 2023

Related U.S. Application Data

(63) Continuation-in-part of application No. 17/678,452, filed on Feb. 23, 2022, which is a continuation of (Continued)

(51) Int. Cl.

| | |
|---|---|
| ***B65D 81/133*** | (2006.01) |
| ***B65D 5/50*** | (2006.01) |
| ***B65D 65/46*** | (2006.01) |

(52) U.S. Cl.

CPC ..... *B65D 81/133* (2013.01); *B65D 5/5038* (2013.01); *B65D 65/466* (2013.01); *B65D 2581/053* (2013.01)

(58) Field of Classification Search

CPC .. B65D 81/133; B65D 5/5038; B65D 65/466; B65D 2581/053

(Continued)

(56) References Cited

U.S. PATENT DOCUMENTS

| | | | |
|---|---|---|---|
| 2,330,345 | A | 9/1943 | Elliott |
| 3,095,086 | A | 6/1963 | Berg |

(Continued)

FOREIGN PATENT DOCUMENTS

| | | | |
|---|---|---|---|
| EP | 2 241 516 | A1 | 10/2010 |
| EP | 3 772 469 | A1 | 2/2021 |

(Continued)

OTHER PUBLICATIONS

European Office Action dated Sep. 21, 2023 received in 20 217 267.2.

(Continued)

*Primary Examiner* — Jacob K Ackun

(74) *Attorney, Agent, or Firm* — Scully, Scott Murphy & Presser, P.C.

(57) ABSTRACT

An insert including a folded body including: a main panel having a top surface and an aperture to accommodate a container; first and second structural tubes at first and second opposing ends of the folded body; the first structural tube includes a first side folded away from the top surface, a second side folded from the first side and a third side folded from the second side towards a bottom surface; and the second structural tube comprises a fourth side folded away from the top surface, a fifth side folded from the fourth side and a sixth side folded from the fifth side towards the bottom surface. One of the third and sixth sides having a cradle provided within the aperture, the cradle being a cut-out; and a platform disposed in the aperture and offset from the top surface, the platform being a part of the folded body.

23 Claims, 13 Drawing Sheets

Related U.S. Application Data application No. 17/004,310, filed on Aug. 27, 2020, now Pat. No. 11,267,636.

(60) Provisional application No. 62/953,297, filed on Dec. 24, 2019.

(58) Field of Classification Search
USPC ..... 206/564, 581, 486, 487, 485, 488, 562, 206/763, 765, 588, 589; 211/72, 73, 74
See application file for complete search history.

(56) References Cited

U.S. PATENT DOCUMENTS

| | | | | |
|---|---|---|---|---|
| 4,026,411 | A | 5/1977 | Johnson | |
| 4,194,617 | A | 3/1980 | Bandell | |
| 5,385,238 | A | 1/1995 | Lancaster et al. | |
| 5,884,767 | A | 3/1999 | Peng | |
| 5,979,646 | A | 11/1999 | Strachan | |
| 6,301,860 | B1 | 10/2001 | Gunderman et al. | |
| 6,401,927 | B1 | 6/2002 | Sorensen et al. | |
| 6,474,473 | B2 | 11/2002 | Wong | |
| 7,533,774 | B2 | 5/2009 | Zimmerman | |
| 7,549,537 | B2 | 6/2009 | Hsu | |
| 7,621,402 | B2 | 11/2009 | Sandow | |
| 8,272,509 | B1 | 9/2012 | McCutchen | |
| 8,307,984 | B1 | 11/2012 | Collierc | |
| 11,267,636 | B2 * | 3/2022 | Henigman | B65D 65/466 |
| 2002/0148744 | A1 | 10/2002 | Hsu | |
| 2005/0279668 | A1 | 12/2005 | Nash, Jr. et al. | |
| 2008/0067106 | A1 | 3/2008 | Kuo | |
| 2010/0133138 | A1 | 6/2010 | Fox | |
| 2011/0132779 | A1 | 6/2011 | Loughman et al. | |
| 2022/0411124 | A1 | 12/2022 | Henigman et al. | |
| 2023/0219734 | A1 | 7/2023 | Henigman | |

FOREIGN PATENT DOCUMENTS

| | | | |
|---|---|---|---|
| EP | 3 841 915 | A1 | 6/2021 |
| EP | 3 858 753 | A1 | 8/2021 |
| GB | 2478575 | A | 9/2011 |
| KR | 20220105504 | A | 7/2022 |
| WO | 2006/015117 | A1 | 2/2006 |
| WO | 2018/002791 | A1 | 1/2018 |

OTHER PUBLICATIONS

US Office Action dated Oct. 29, 2024 received in U.S. Appl. No. 18/119,482.
Extended European Search Report dated Jun. 5, 2023 received in 24152681.3.
Extended European Search Report dated Jul. 29, 2022 received in 22161584.2.
Extended Partial European Search Report dated Aug. 19, 2022 received in 22165577.2.
US Notice of Allowance dated Jan. 25, 2022 received in U.S. Appl. No. 17/004,310.
US Office Action dated Jan. 31, 2023 received in U.S. Appl. No. 17/678,452.

* cited by examiner

ENVIROTRAY INSERT FOR PROTECTING AN OBJECT WITHIN AN OUTER CONTAINER

CROSS-REFERENCE TO RELATED APPLICATIONS

The present application is a Continuation-In-Part application of U.S. application Ser. No. 17/678,452, filed on Feb. 23, 2022, which is a Continuation application of U.S. application Ser. No. 17/004,310 filed on Aug. 20, 2020, which claims priority to U.S. provisional application No. 62/953,297 filed 24 Dec. 2019, the entirety of which is incorporated by reference. The entire contents of each of which are incorporated here by reference.

BACKGROUND

Consumer good products, such as cosmetic or treatment products for human beautification purposes are well known and have been used by humans for thousands of years. In modem times, cosmetic and treatment products are bought by customers of cosmetic-product manufacturers, which are provided to customers in various types of packaging. While the packaging provides useful protective and decorative functions, packing in general is becoming problematic when it is non-recyclable, non-biodegradable and adds to our global environmental problems. For example, discarded cosmetic-product packaging adds to waste and pollution within the environment.

There is increasingly a growing concern about adapting human society to a more sustainable utilization of resources, such as more sustainable use of energy and materials, with an emphasis on reducing waste, and in particular, plastics-material waste. Notably, disposal of waste, such as plastics-material waste by way of dumping in ground or water bodies results in addition of plastics-material nanoparticles in soil and water bodies like rivers and oceans. Such addition of the plastics-material nanoparticles reduces fertility of soil and makes water unfit for drinking and other purposes. Recycling and re-use are important issues for sustainable utilization of resources which are used in making the cosmetic-product packaging, recycling and sustainability is more easily accomplished using paper-based products.

Therefore, there arises a need for a cosmetic-product packaging that not only provides protection for a given cosmetic product from a given manufacturer to a given customer, but aesthetically appeals and is useful to the given customer, such that the given customer retains and cherishes the cosmetic-product packaging for long term use, rather than merely discarding the cosmetic-product packaging at an earliest opportunity.

There is an ongoing need in the field of packaging for environmentally-friendly packaging and containers; particularly those configured for functioning as a tray for inserting into an outer packaging. There is a particular need for this in the cosmetic industry. Typically, such inserts and other packaging materials are made of non-biodegradable plastic, and there is a need to move to paper based packaging material.

SUMMARY

Provided therefore herein is a recyclable and biodegradable packaging insert for holding consumer goods in place within a package. In an embodiment, the recyclable packaging insert holds consumer goods which are cosmetics or treatments. In an embodiment, the recyclable and biodegradable packaging insert is made of solid paper board or corrugated paper board. In another embodiment, the insert is a horizontally layered construction designed to secure said consumer goods efficiently and ergonomically.

In an embodiment, the present invention includes a recyclable and biodegradable packaging insert for retaining a consumer good in place within outer packaging. The insert is a tray with a topside and a bottomside, the topside comprising at least one aperture for retaining a consumer good therein, and the bottomside comprising an exterior vertically extending member and an interior vertically extending member. The exterior vertically extending member and the interior vertically extending members combine to form a multilayer reinforcement structure on the bottomside of the tray.

In an embodiment, the tray is horizontally oriented with the exterior vertically extending member and the interior vertically extending member each projecting substantially perpendicularly from the bottomside of the tray. In an embodiment, the topside is a substantially planar surface and the at least one aperture is recessed in from the planar surface in a mated shape, mated to a preselected consumer good in order to secure a selected consumer good.

In an embodiment, the recyclable and biodegradable packaging insert the mated shape of the at least one aperture has a depth which is a length just greater than half of a selected dimension of said selected consumer good which is placed in the at least one aperture. In yet another embodiment, the exterior vertically extending member forms a structural support along a perimeter of said packaging insert.

In another embodiment, the packaging insert is a rectangle and two exterior 10 vertically extending members are located on opposing sides of the rectangle. In an embodiment, the interior vertically extending member forms a sidewall of said at least one aperture. In another embodiment, the exterior vertically extending member is affixed to the bottomside of the packaging insert by horizontal flanges extending from the exterior vertically extending member. The interior vertically extending member may be affixed to the horizontal flanges by second horizontal flanges extending from the interior vertically extending member and creating a layered structure on said bottom side of the packaging insert.

For a better understanding of the present invention, together with other and further objects and advantages, reference is made to the following detailed description, taken in conjunction with the accompanying examples, and the scope of the invention will be pointed out in the appended claims. The following detailed description is not intended to restrict the scope of the invention by the advantages set forth above.

DETAILED DESCRIPTION

The packaging insert provides an easy to assemble, sturdy paper-based packaging insert for use in the cosmetic industry. The packaging insert is advantageous over the prior art because it is biodegradable and considerably faster and more economical from concept to supply than plastic.

As used herein, the term paperboard broadly refers to a thick paper-based material; i.e., paper with an increased structural element. While there is no rigid differentiation between paper and paperboard, paperboard is generally thicker (usually over 0.30 mm, 0.012 in) than paper, and has certain superior attributes such as foldability and rigidity. In a non-limiting definition, paperboard is a paper with a grammage above 250 g/m$^2$. Paperboard can be single- or multi-ply.

Paperboard can be easily cut and formed, is lightweight, and because it is strong, is used in packaging. Paperboard is sometimes referred to as cardboard, which is a generic, lay term used to refer to any heavy paper pulp-based board, however this usage is deprecated in the paper, printing and packaging industries as it does not adequately describe each product type. Paperboard can be corrugated (i.e., having a series of parallel ridges and furrows), or non-corrugated. In a preferred embodiment of the invention, the paperboard is corrugated.

As used herein, "recyclable" refers to an ability and likelihood of a material to reacquire to be re-used, and thus acquire the properties it had in its original state. It is an alternative to "conventional" waste disposal that can save material and help lower greenhouse gas emissions. Recycling can prevent the waste of potentially useful materials and reduce the consumption of fresh raw materials, thereby reducing energy usage, air pollution (from incineration), and water pollution (from landfilling). Paper based products are more easily and more likely than plastic to be recyclable, and thus beneficial in use from this perspective.

As used herein, "biodegradable" refers to a plant based composition which is compostable and capable of disintegrating into natural elements in a compost environment, leaving no toxicity in soil or water.

A GFP Envirotray is designed to protect objects within an outer container (box) from impact or abrasion. Packaging is made from paper board or fiber board, which can be corrugated or solid paper board. A horizontal portion (face) of folded board is cut with apertures to match the cross sectional plane of the object (product) to be retained just above its equator to facilitate good retention. The retention is accomplished by a slight deformation of the cut aperture which returns to its normal state upon the retained object passing through it just beyond its equator.

Figure 1:
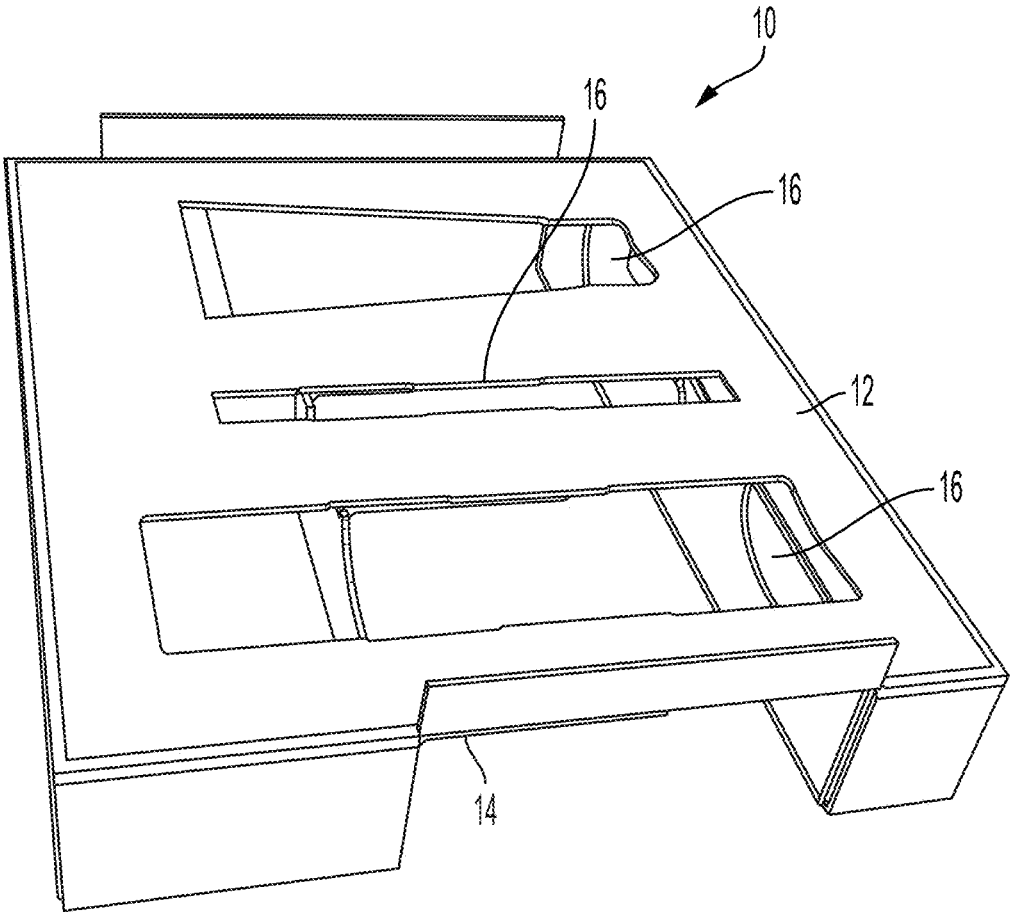
FIG. 1 shows an overview perspective of a packaging insert.

With reference now to the drawings, FIG. 1 shows a top plan view of a recyclable and biodegradable packaging insert 10. A topside 12 is shown with an opposed bottomside 14 facing the opposite direction of topside 12. Topside 12 includes apertures 16 designed to retain consumer goods (not shown in FIG. 1) therein. Tray 10 is horizontally oriented with exterior and interior vertically extending members projecting in perpendicular orientation with respect to tray 10 from bottomside 14 as more clearly seen in FIG. 3. Apertures 16 are recessed in from topside 12 in a shape mated to a preselected consumer good so that said consumer good is sized to fit snugly in aperture 16.

Figure 2:
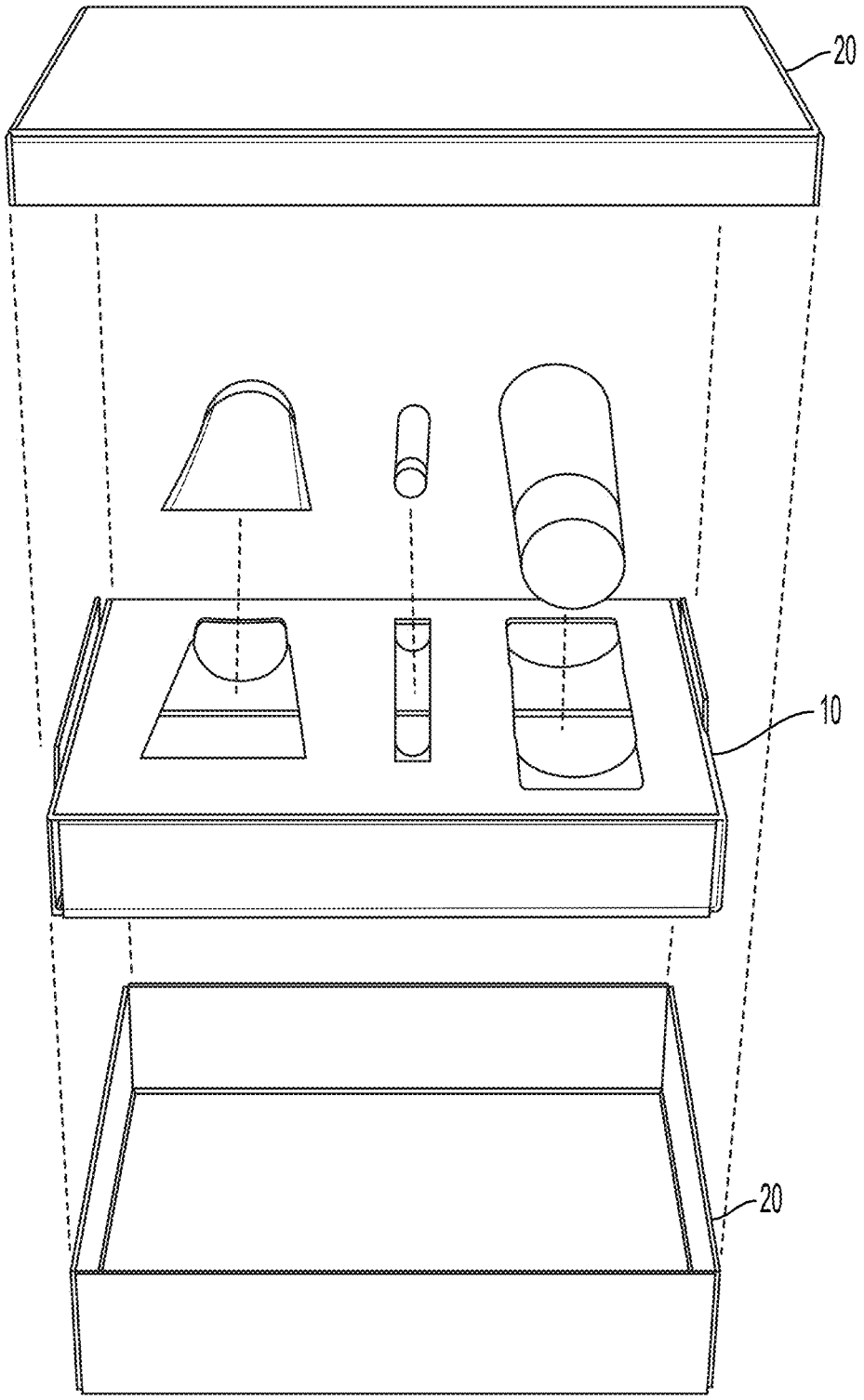
FIG. 2 shows an exploded overview perspective of the packaging insert, including consumer goods and a container into which the insert is utilized.

With reference now to FIG. 2 of the drawings, packaging insert tray 10 is shown in exploded with view with box 20 into which it is inserted. Packaging insert 10 may be rectangular in shape as shown in FIG. 2 and fit snugly within a rectangular box 20.

Figure 3:
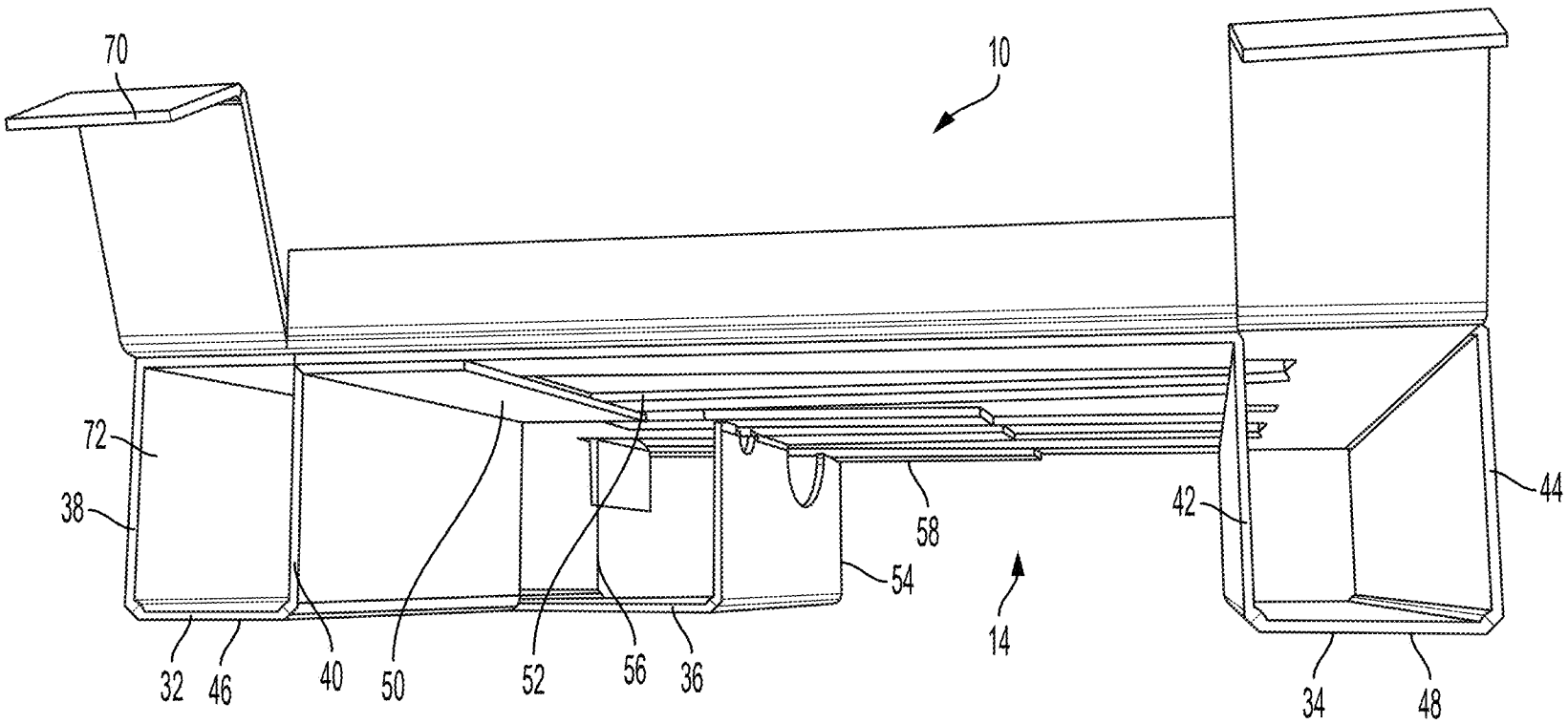
FIG. 3 shows a cross-sectional view of the packaging insert.
Figure 4:
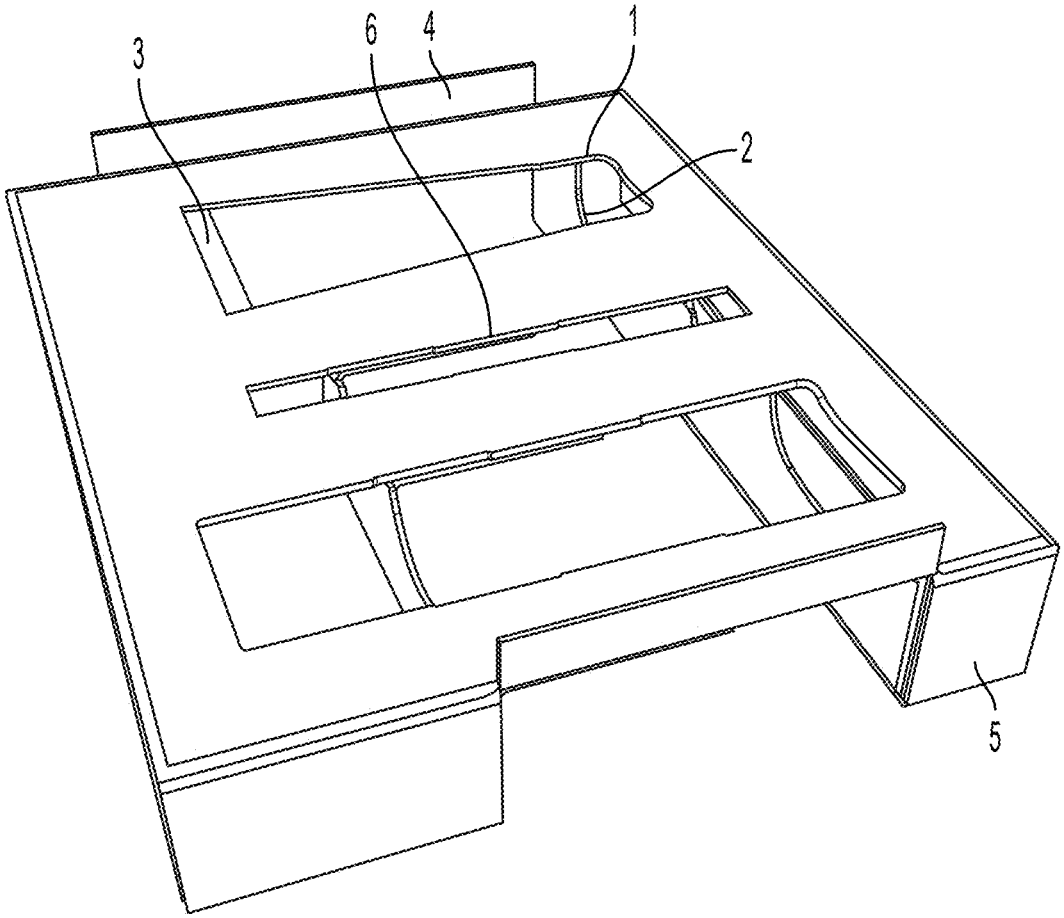
FIG. 4 shows another perspective view of the packaging insert.

With reference now to FIG. 3 of the drawings, an exterior vertically extending members 32 and 34 are shown on either side of the rectangular shaped insert 10. An interior vertically extending member 36 is also shown protruding from bottomside 14 of packaging insert 10. Exterior vertically extending members 32 and 34 are comprised of parallel sidewalls 38 and 40 (for exterior vertically extending member 32), and 42 and 44 (for exterior vertically extending member 34), each of which are connected by bottom panels 46 and 48 perpendicularly oriented with respect to the sidewalls. An exterior vertically extending member, or sidewall 38 can also serve as a structural support along a perimeter of rectangular tray 10. It is also seen that exterior vertically extending 10 members 32 and 34, and sidewalls 38 and 44 form opposing sides of rectangular tray 10.

Interior vertically extending member 36 also includes parallel sidewalls 54 and 56, which form sidewalls of aperture, such as an interiorly situated aperture 16 shown in FIG. 1. Horizontal flange 58 extends from parallel sidewall 54 and serves to attach it to tray bottomside 14 of tray 10.

Sidewalls 38 and 40 can be attached to bottomside 14 of packaging insert 10 by reinforcement structure, or horizontal flange 50. Similarly, sidewalls 42 and 44 are attached to bottomside 14 by reinforcement structure, or flange 52. Reinforcement structures, or flanges 50, 52, and 58 also form a multilayer reinforcement structure on bottomside 14.

Figure 5:
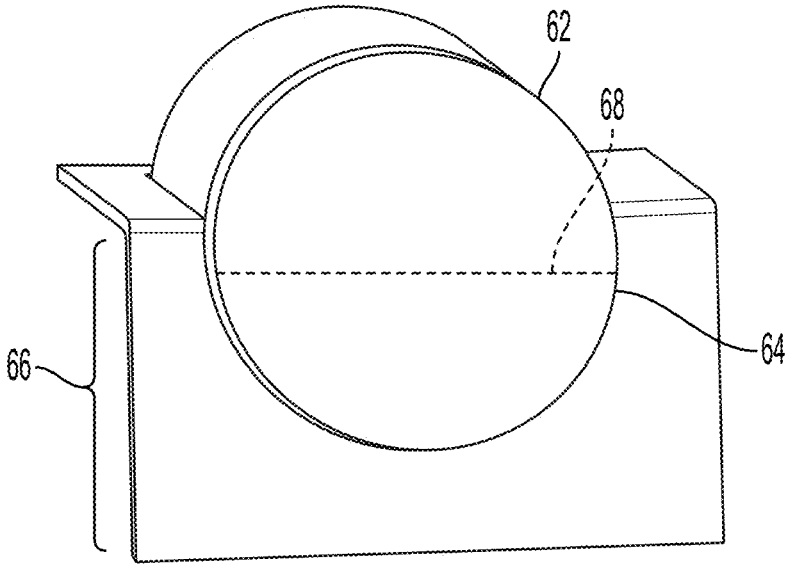
FIG. 5 is a schematic drawing showing how consumer goods are placed in the packaging insert.
Figure 6A:
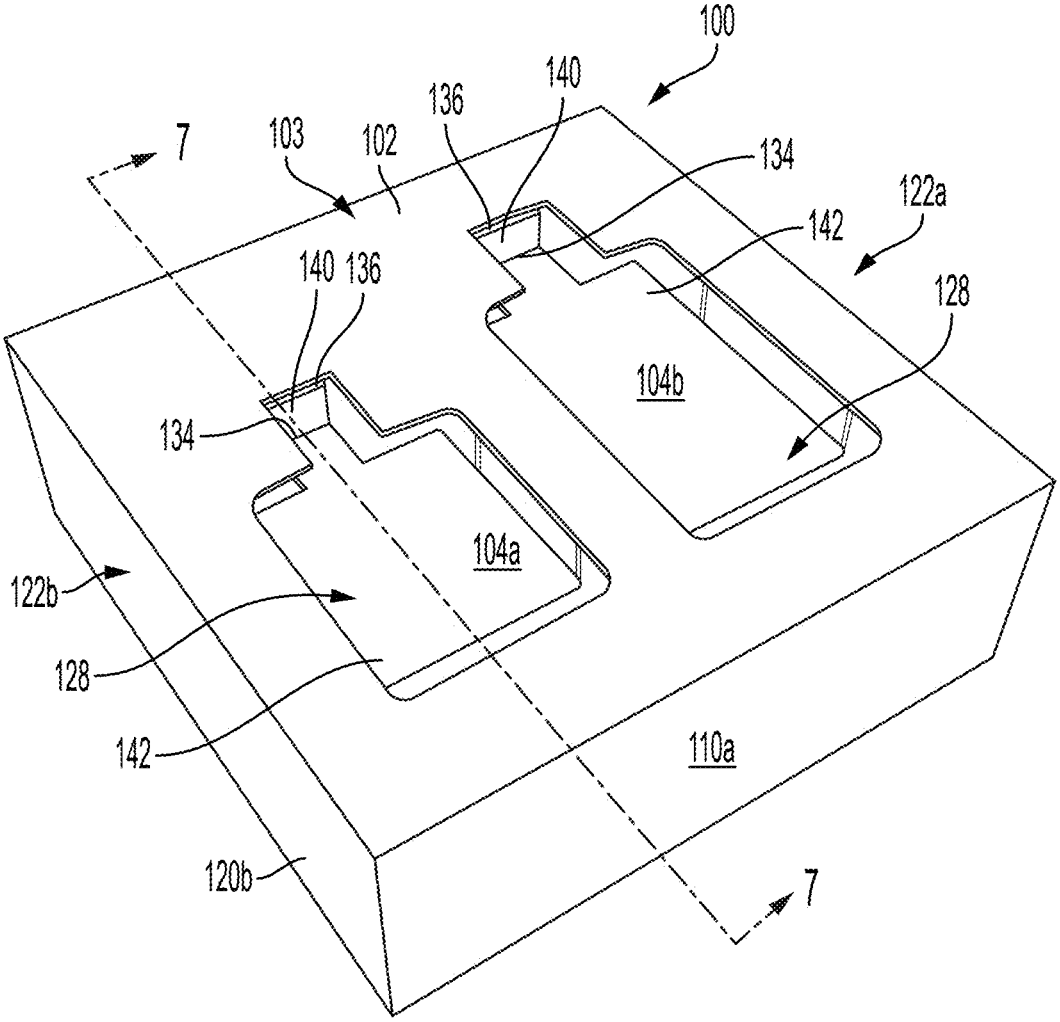
FIG. 6*a* illustrates a perspective view of another embodiment of packaging insert.
Figure 6B:
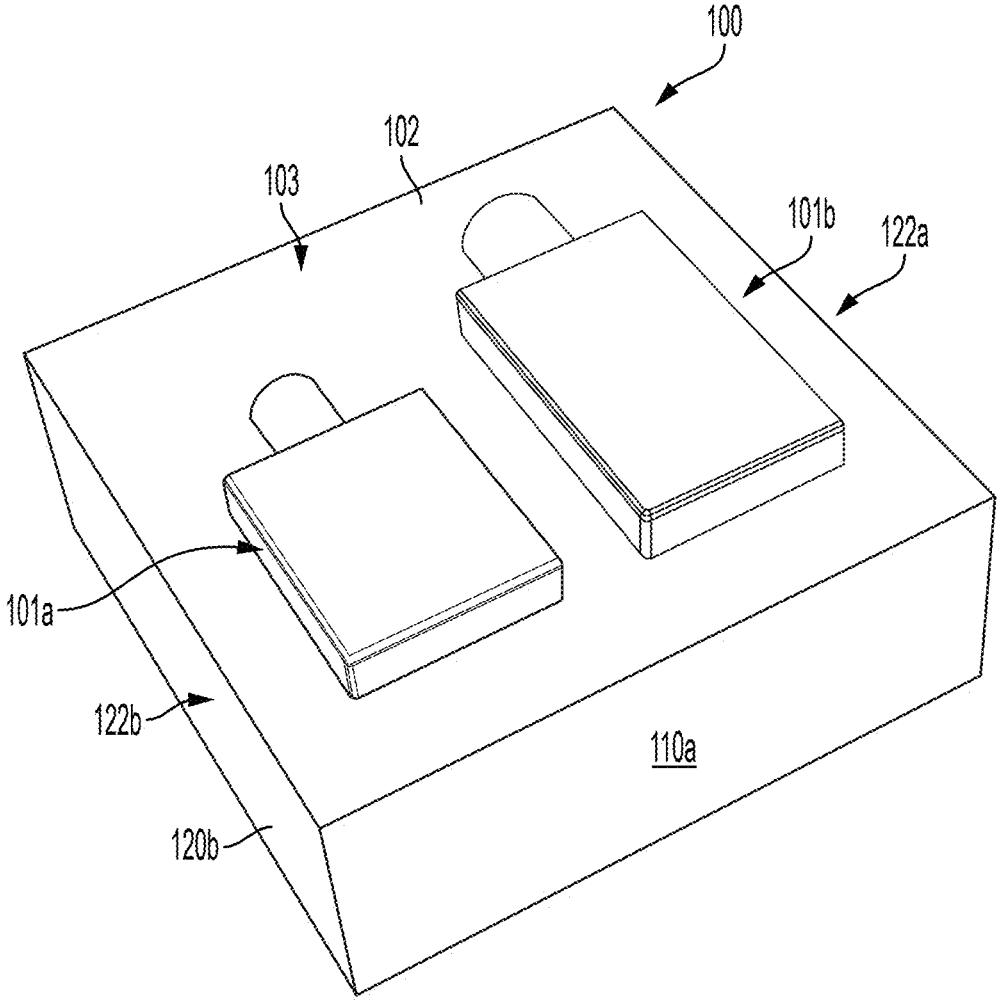
FIG. 6*b* illustrates the perspective view of the packaging insert of FIG. 6*b* with a container disposed in each aperture.

With reference now to FIG. 5 of the drawings, it can be seen how a consumer good 62, in this case cylindrically-shaped, is snugly fit into a mated aperture 64. Aperture 64 has a depth 66 which is a length of just greater than a pre-selected dimension of consumer good 62, such consumer good 62 can be snugly fit in aperture 64. A halfway-point of a pre-selected dimension of consumer good 62, in this case a cross-sectional diameter of a cylindrical object is shown at equator 68 of consumer good 62. Taking a cross-section of consumer good 62, equator 68 is a radius of the cross-section of the cylinder. Depth 66 is therefore sized according to fit consumer good 62 so that equator 68 is firmly situated in aperture 64. As can be seen, the depth 66 of aperture 64 is just longer than the radius of consumer good 62.

With further reference to FIGS. 3 and 5, a vertical portion of the folded board (also known as packaging insert tray) 10 is cut to match the cross sectional plane perpendicular to the equator of the retained object in order to precisely control the position of the object within the aperture and maximize the contact area between holder and object to minimize possible damage to object. This vertical member is located inward from the end of the object by means of multiple consecutive folds, or horizontal flanges, in the board which eventually terminates by being glued or otherwise attached to the underside, or bottomside, of the face containing the apertures. There are a minimum of two vertical members (interior and exterior) originating from opposing sides of the face portion of the board and folding downward to start the sequence of folds. Vertical member 42 terminates at the first fold of vertical member 54, and vertical member 54 terminates by being glued or attached by other means to the underside of vertical member 42, this reinforces the face portion of tray 10 by producing a multilayer reinforcement.

Retention locks specific to crimped or heat sealed tubes (such as toothpaste or creme). Tubes are difficult to retain on the crimped or heat sealed end due to their structural weakness and variation in dimension. This lock accommodates the sealed end of the tube by providing a slot for the edge to slip into and engages the tube at its seal (crimp) in the lateral direction and beyond the seal in the longitudinal direction.

Vertical flaps 70 folded upwards from substrate to engage the top of outer container in order to prevent contact between retained objects and outer container.

Assembly locks designed to retain the shape of the packaging to facilitate inserting product into the package and inserting completed assembly into outer package. The locking is accomplished by means of flap 70 being tucked into cavity 72 and preventing the folded section from returning to its flat state.

Retention tabs designed to enhance the holding strength of the interference fit of the aperture by providing additional pressure and coverage.

Figure 9:
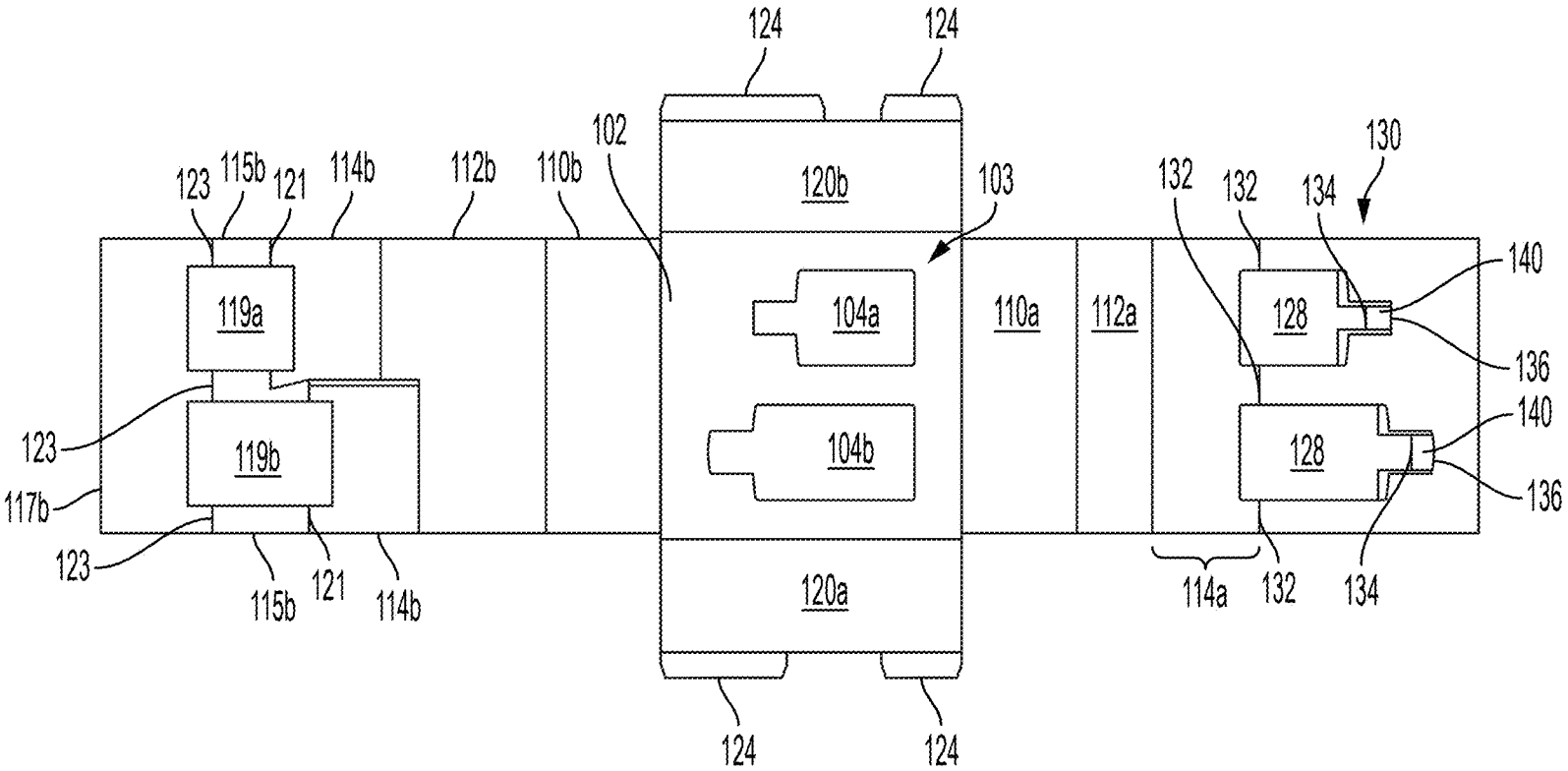
FIG. 9 illustrates a flat pattern of the packaging insert of FIG. 6 prior to folding into the packaging insert illustrated in FIG. 6.

Referring now to FIGS. 6*a* and 6*b*-8, there is shown another embodiment of packaging insert, referred to generally with reference number 100. Similar to the packaging insert previously described, the packaging insert 100 is formed of a flat pattern (see FIG. 9 discussed below) of paper board, folded and adhesive applied to portions of the folded body, as necessary.

The packaging insert 100, when fully folded and adhered, if necessary, includes a main panel 103 having a top surface 102. The top surface 102 having first and second apertures 104*a*, 104*b* configured to accept a container 101*a*, 101*b*, such as perfume, cosmetics and the like. The number of apertures is not limited to two and can be one or more than two. Further, although the apertures are shown to mimic a shape of the container retained therein, the shape of the aperture is not so limited and can be a general shape for retaining the container, such as a rectangular shape that retains a portion of the container while having a clearance around other portions (such as around a cap of the container).

Figure 10:
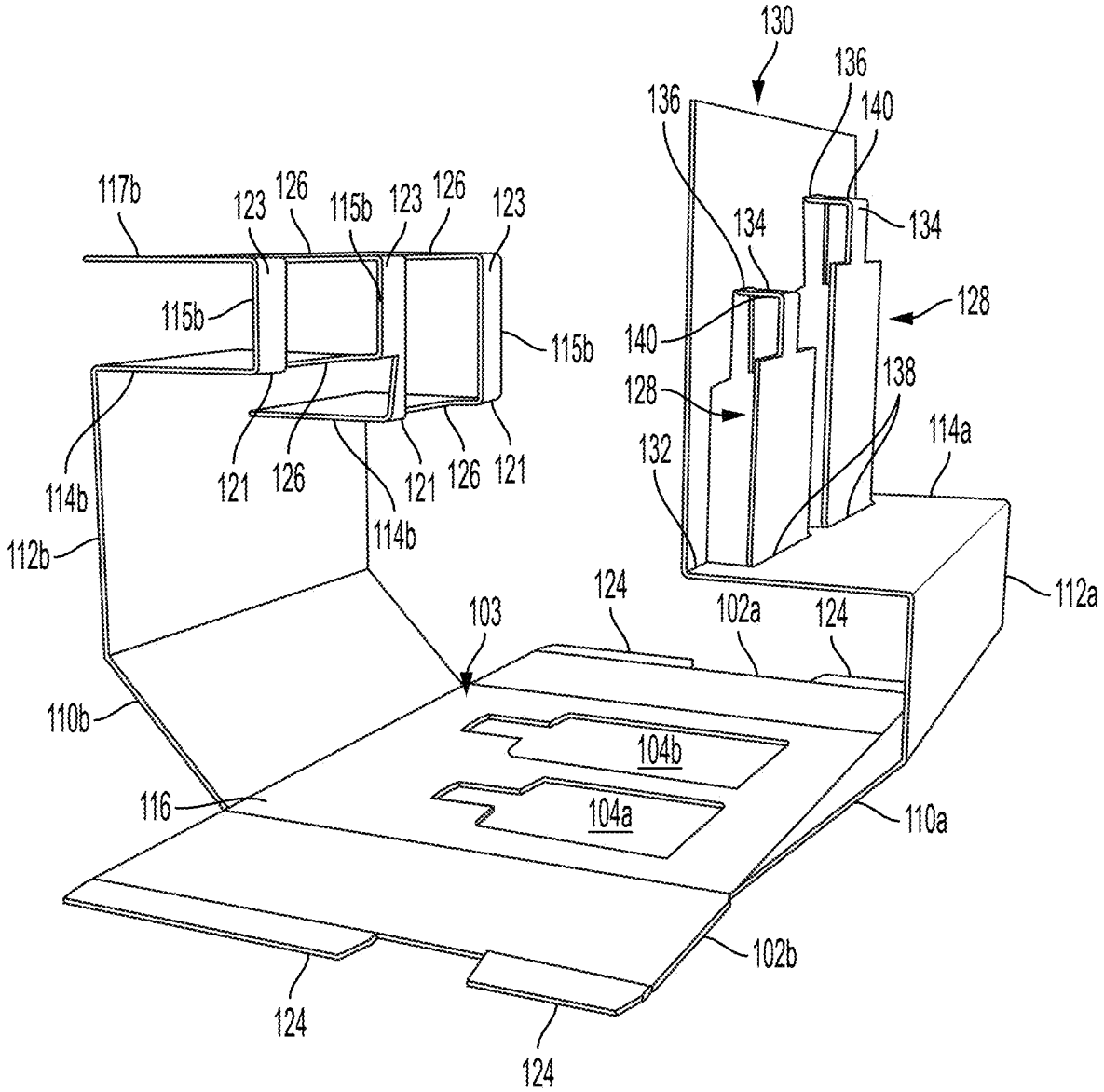
FIG. 10 illustrates a first state of folding of the flat pattern of FIG. 9.
Figure 11:
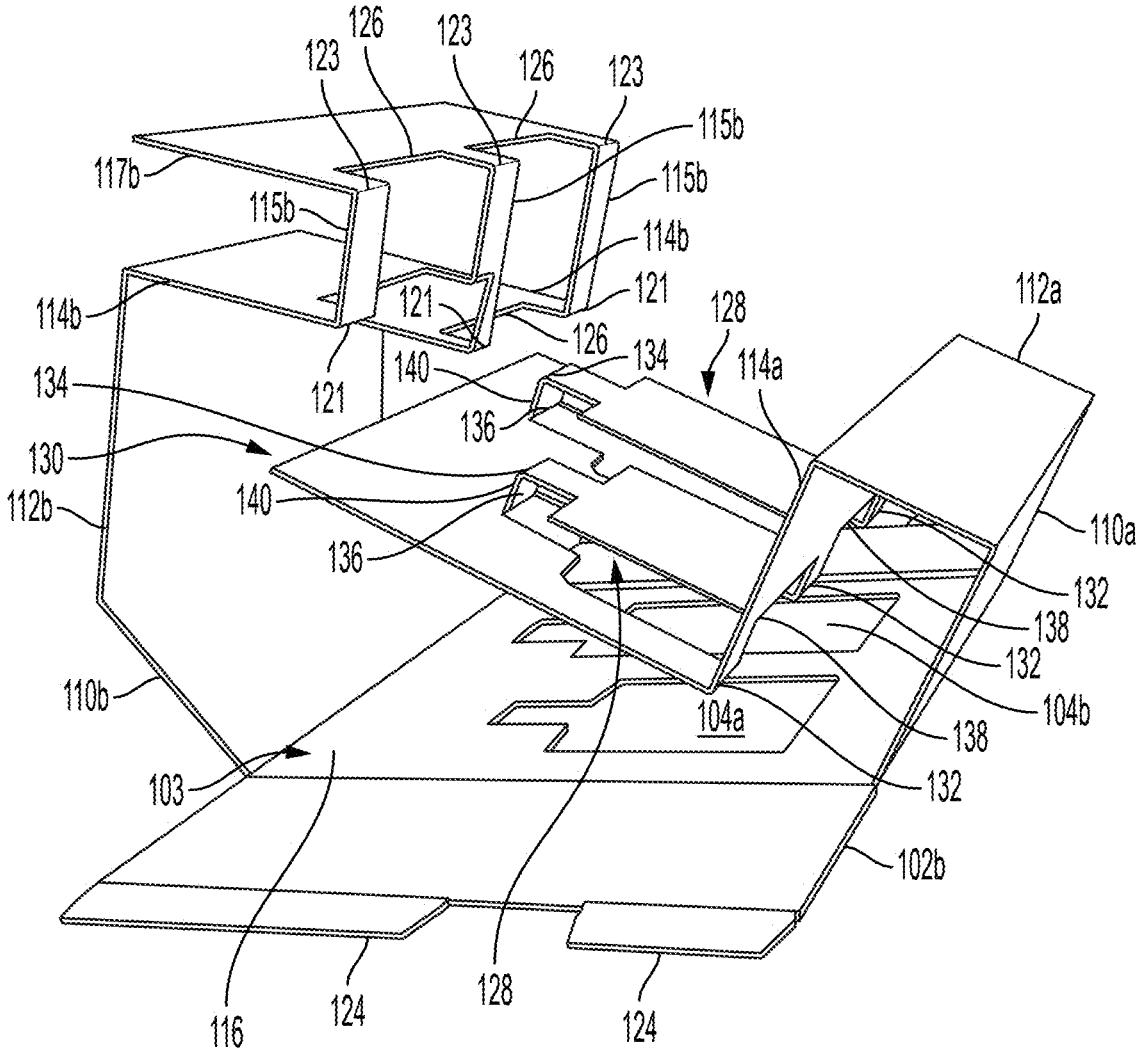
FIG. 11 illustrates a second state of folding of the flat pattern of FIG. 9, subsequent to the first state of folding illustrated in FIG. 10.
Figure 12:
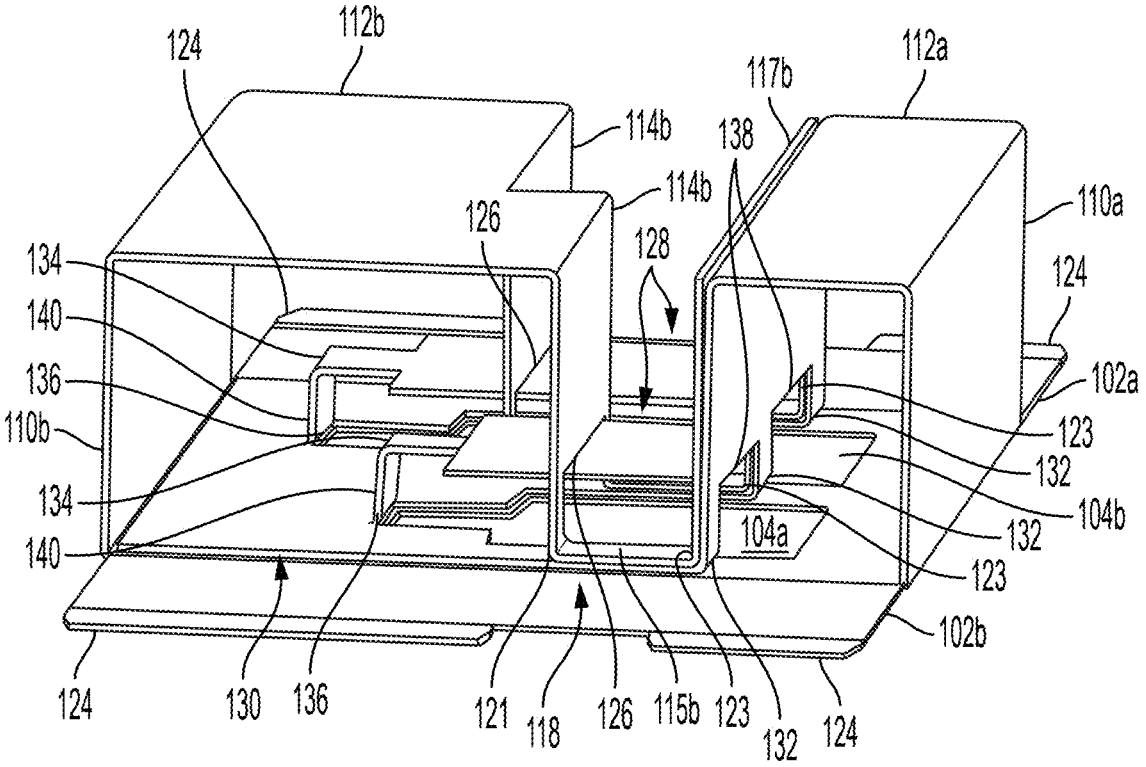
FIG. 12 illustrates the packaging tray of FIG. 11 with the folded body fully folded with the exception of an end cap.

The packaging insert further includes first and second tubular structures 106*a*, 106*b* disposed at opposing ends 108*a*, 108*b* of the packaging insert 100. Each tubular structure having an outer wall 110*a*, 110*b* folded from the top surface 102, a bottom wall 112*a*, 112*b* folded from the side walls 110*a*, 110*b*, and a return wall 114*a*, 114*b* folded from the bottom walls 112*a*, 112*b* to return toward an inner surface 116 of the top surface 102. Such folds can be such that adjacent walls are perpendicular to each other, however, the configuration of the packaging insert is not limited to such perpendicular arrangement between adjacent walls. The return walls 114*a*, 114*b* can fold to further extend across the lower surface 116 to provide a laminated bridge 118 that extends between the first and second tubular structures 106*a*, 106*b* and can further fold to extend across the return wall of the other tubular structure. For example, return wall 114*b* can fold to form panel 115*b* to form part of the laminated bridge 118 and panel 115*b* can further fold to form panel 117*b* to extend next to return wall 114*a*. Further, portions of platform panel 130 (described below) other than the platforms 128 can extend along the bottom surface 116 towards wall 110*b* to form part of the laminated bridge 118. As discussed below with regard to FIGS. 9-11, the return wall 114*a* can also fold and extend to form platforms 128.

The packaging insert includes first and second end caps 120*a*, 120*b* folded to cover opposing ends 122*a*, 122*b*. The first and second end caps 120*a*, 120*b* can have one or more tabs 124 (see FIGS. 9-11) for securing the first and second end caps 120*a*, 120*b* to the openings formed by the first and second tubular structures at their respective opposing ends 122*a*, 122*b*.

One or both of the return walls 114*a*, 114*b* can include a cradle 126 for supporting the container in the aperture. A platform 128 is provided within the apertures 104*a*, 104*b* to mask an open corrugation of the cradle 126 and the cavity within the aperture 104*a*, 104*b*, such as where a clear container is retained in the apertures 104*a*, 104*b*. The platform 128 can not only improve overall appearance but also enhance structural integrity. The platform 128 can be used for rectangular cross section bottles but can also be used with cylindrical bottles by using a rectangular shaped cradle 126. The platform 128 can enhance the structure enough to where a form fitting cradle is not critical.

A first cradle 126 for each of the apertures 104*a*, 104*b* is formed by cut-outs 119*a*, 119*b* when return wall is folded along crease 121 relative to panel 115*b* and a second cradle 126 for each of the apertures 104*a*, 104*b* is formed when panel 115*b* is folded along crease 123 relative to panel 117*b*.

Figure 7:
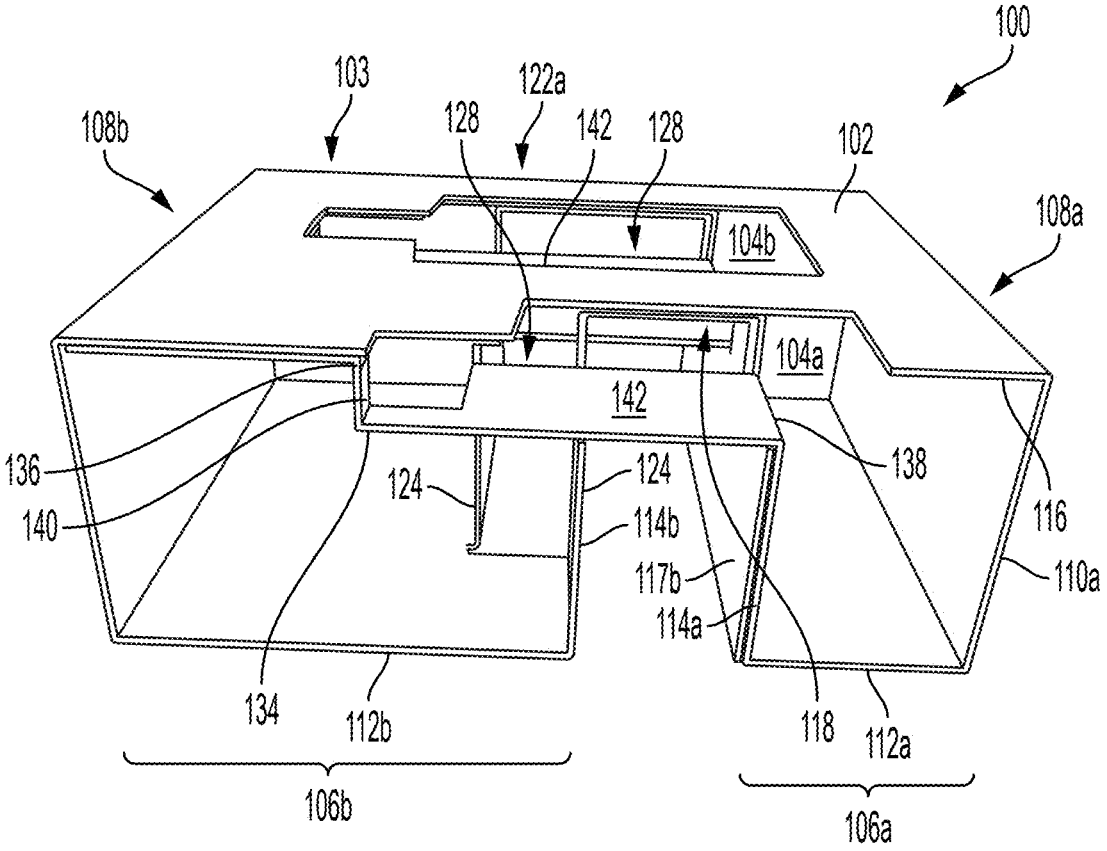
FIG. 7 illustrates a sectional view of the packaging insert of FIG. 6 as taken along section line 7-7.
Figure 8:
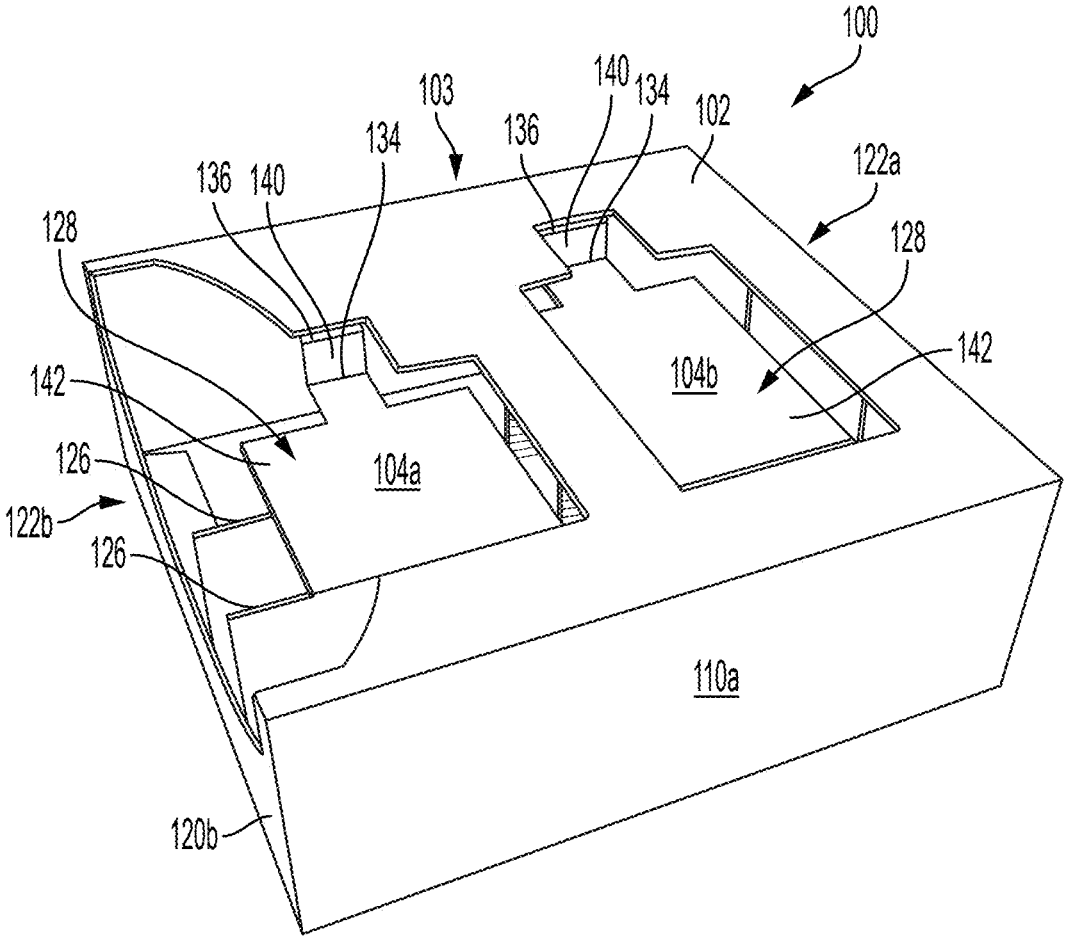
FIG. 8 illustrates a perspective view of the packaging insert of FIG. 6 having a partial cut-away for viewing an internal portion of the packaging insert.

Additionally referring to FIGS. 9-12, the platform 128 is formed by a platform panel 130, which is an extension of the return panel 114*a* folded along the bottom surface 116 along crease line 132 and forcing the platform to hinge along crease lines 134, 136 and 138. That is, the platform 128 is formed by cutting an appropriate shape from the platform panel on less than all sides of such shape such that the platform 126 remains attached to the platform panel 130 and then the platform 126 is folded along crease lines formed between the platform 126 and the sides that remain attached to the platform panel 130. Such shape can mimic the shape of the corresponding aperture 104*a*, 104*b*. The fold along crease lines 134 and 136 form platform support 140. The portion of the platform panel from the bottom wall 112*a* to the crease line 132 forms the return wall 114*a*. The length of platform support 140 from the top surface 102 to the platform 128 and the distance between crease lines 138 and 132 control the offset of the platform 128 from the platform panel 130. Furthermore, the length of the platform 128 within the aperture 104*a*, 104*b* can be shortened or lengthened by adjusting the corresponding length of the bottom wall 112*a*. Although the length L of the platform 128 shown in FIG. 7 is less than the corresponding length of the aperture, the length of the bottom panel 112*a* can be adjusted such that the platform 128 has a substantially same length as the aperture.

Further with regard to FIGS. 6*a* and 6*b*-12, the top surface 102 of the packaging insert is opposite to the exposed surface 142 of the platform 128. Therefore, the paperboard used to form the flat panel in FIG. 9 can have a surface 116 (corresponding to the bottom surface of the folded body) of a first color and an opposite surface (forming the exposed surface 142 of the platform 128) of a second color different from the first color. Additionally or alternatively, the opposite surface, or only a portion thereof forming the exposed surface 142 of the platform 128, can have indicia formed therein, such as by printing. Such indicia can be textual or pictorial, such as a company name and/or logo.

EXAMPLES

The packaging insert is further exemplified, but not limited, by the following representative examples, which are intended to illustrate the invention and are not to be construed as being limitations thereto.

A packaging insert is made by designing, die cutting and subsequently folding and gluing as needed to obtain desired characteristics.

Thus, while there have been described what are presently believed to be preferred embodiments of the invention, those skilled in the art will realize that changes and modifications may be made thereto without departing from the spirit of the invention, and it is intended to claim all such changes and modifications as fall within the true scope of the invention.

What is claimed is:

1. An insert configured to hold a container, the insert comprising:

a folded body formed of paper board, the folded body comprising:

a main panel having a top surface, the main panel having an aperture configured to accommodate and retain the container therein;

first and second structural tube ends, respectively, at respective first and second opposing ends of the folded body;

the first structural tube end comprises a first side folded away from the top surface, a second side folded from the first side and a third side folded from the second side towards a bottom surface of the main panel; and the second structural tube end comprises a fourth side folded away from the top surface, a fifth side folded from the fourth side and a sixth side folded from the fifth side towards the bottom surface of the main panel;

one of the third and sixth sides having a cradle provided within the aperture to support the container, the cradle being a cut-out in the at least one of the third and sixth sides; and a platform disposed in the aperture and offset from the top surface towards the cradle, the platform being a part of the folded body.

2. The insert according to claim 1, wherein the paper board has a thickness of more than 0.012 inches.

3. The insert according to claim 1, wherein the paper board has a grammage of more than 250 g/m$^2$.

4. The insert according to claim 1, wherein the folded body having a bridge supported at least between the first and second structural tube ends.

5. The insert according to claim 4, wherein:

the bridge being a laminated structure formed by a first main portion of the folded body having the top surface and by second and third main portions extending from the first and second structural tube ends, respectively.

6. The insert according to claim 5, wherein the second main portion being folded from the third side parallel to the first main portion to form part of the laminated structure of the bridge and the third main portion being folded from the sixth side parallel to the first main portion to form part of the laminated structure of the bridge.

7. The insert according to claim 6, wherein the first, second and third main portions extend an entire length between the first and second structural tube ends to form a three layer lamination between the first and second structural tube ends.

8. The insert according to claim 7, wherein the third main portion forming a bottom surface of the bridge, the third main portion further having a return extending from the third main portion, the return being bent to extend along the third side of the first structural tube end.

9. The insert according to claim 1, wherein the cradle comprises a rectangular cut-out.

10. The insert according to claim 1, wherein the other of the third and sixth sides being folded into a platform panel, the platform panel extending along the bottom surface of the main panel, the platform having a first end folded from the other of the third and sixth panels and the platform having a second end folded from the platform panel.

11. The insert according to claim 10, wherein the second end comprises first and second folds defining a platform support panel between the platform and the platform panel.

12. An insert package comprising:

a container; and a folded body formed of paper board, the folded body comprising:

a main panel having a top surface, the main panel having an aperture configured to accommodate and retain the container therein;

first and second structural tube ends, respectively, at respective first and second opposing ends of the folded body the first structural tube end comprises a first side folded away from the top surface, a second side folded from the first side and a third side folded from the second side towards a bottom surface of the main panel; and the second structural tube end comprises a fourth side folded away from the top surface, a fifth side folded from the fourth side and a sixth side folded from the fifth side towards the bottom surface of the main panel;

at least one of the third and sixth sides having a cradle provided within the aperture to support the container, the cradle being a cut-out in the at least one of the third and sixth sides; and a platform disposed in the aperture and offset from the top surface towards the cradle, the platform being a part of the folded body.

13. The insert package according to claim 12, wherein the paper board has a thickness of more than 0.012 inches.

14. The insert package according to claim 12, wherein the paper board has a grammage of more than 250 g/m$^2$.

15. The insert package according to claim 12, wherein the folded body having a bridge supported at least between the first and second structural tube ends.

16. The insert package according to claim 15, wherein:

the bridge being a laminated structure formed by a first main portion of the folded body having the top surface and by second and third main portions extending from the first and second structural tube ends, respectively.

17. The insert package according to claim 16, wherein the second main portion being folded from the third side parallel to the first main portion to form part of the laminated structure of the bridge and the third main portion being folded from the sixth side parallel to the first main portion to form part of the laminated structure of the bridge.

18. The insert package according to claim 17, wherein the first, second and third main portions extend an entire length between the first and second structural tube ends to form a three layer lamination between the first and second structural tube ends.

19. The insert package according to claim 18, wherein the third main portion forming a bottom surface of the bridge, the third main portion further having a return extending from the third main portion, the return being bent to extend along the third side of the first structural tube end.

20. The insert package according to claim 12, wherein the cradle comprises a rectangular cut-out.

21. The insert package according to claim 12, wherein the other of the third and sixth sides being folded into a platform panel, the platform panel extending along the bottom surface of the main panel, the platform having a first end folded from the other of the third and sixth panels and the platform having a second end folded from the platform panel.

22. The insert package according to claim 21, wherein the second end comprises first and second folds defining a platform support panel between the platform and the platform panel.

23. The insert package according to claim 12, wherein the container has a rectangular cross-section.

* * * * *